United States Patent [19]

Schwenger

[11] Patent Number: 5,005,890

[45] Date of Patent: Apr. 9, 1991

[54] LIFTING CLAMP

[75] Inventor: Willy Schwenger, Sussen, Fed. Rep. of Germany

[73] Assignee: Carl Stahl GmBH, Fed. Rep. of Germany

[21] Appl. No.: 417,467

[22] Filed: Oct. 5, 1989

[30] Foreign Application Priority Data

Oct. 11, 1988 [DE] Fed. Rep. of Germany ... 8812717[U]

[51] Int. Cl.[5] ..... B66C 1/44

[52] U.S. Cl. ..... 294/103.1; 294/101

[58] Field of Search ..... 294/103.1, 101, 901, 294/87.1; 269/241-244, 251, 271

[56] References Cited

U.S. PATENT DOCUMENTS

| | | | |
|---|---|---|---|
| 2,370,042 | 2/1945 | Jesionowski | 269/242 |
| 2,420,002 | 5/1947 | McKay | 269/269 |
| 2,604,352 | 7/1952 | Gonser | 294/78 |
| 2,662,433 | 12/1953 | Braun | 269/244 X |
| 2,919,614 | 1/1960 | Reason et al. | 269/232 |
| 3,269,766 | 8/1966 | Gardner | 294/103.1 X |
| 3,650,522 | 3/1972 | Wermuth et al. | 269/244 X |
| 4,183,571 | 1/1980 | Renfroe | 294/103.1 X |
| 4,384,739 | 5/1983 | Gustavsson et al. | 294/87.1 |
| 4,417,361 | 11/1983 | Smith | 294/103.1 X |
| 4,850,630 | 7/1989 | Davies | 294/103.1 |

FOREIGN PATENT DOCUMENTS

| | | |
|---|---|---|
| 669554 | 12/1965 | Belgium . |
| 1126098 | 3/1962 | Fed. Rep. of Germany . |
| 2512236 | 10/1976 | Fed. Rep. of Germany . |
| 2644290 | 4/1977 | Fed. Rep. of Germany . |
| 2754964 | 7/1978 | Fed. Rep. of Germany . |
| 900785 | 7/1945 | France . |
| 1099580 | 9/1955 | France . |
| 1460024 | 11/1966 | France . |
| 2342937 | 9/1977 | France . |

OTHER PUBLICATIONS

Maschinenmarkt, Würzburg 84,1978, p. 638.

*Primary Examiner*—Margaret A. Focarino
*Assistant Examiner*—Dean J. Kramer
*Attorney, Agent, or Firm*—Roylance, Abrams, Berdo & Goodman

[57] ABSTRACT

A lifting clamp includes a clamp body defining a chamber for receiving articles, first and second opposing and facing jaws coupled to the clamp body, and a drive mechanism, coupling the second jaw to the clamp body for moving the second jaw along a path relative to the first jaw within the chamber to engage the articles between the jaws. The drive mechanism has a spindle with first and second spindle parts. The first spindle part is rotatably mounted in the clamp body. The second spindle part supports the second jaw and is guided for longitudinal movement in the first spindle part. The first spindle part drives the second spindle part to move the second jaw.

23 Claims, 2 Drawing Sheets

LIFTING CLAMP

FIELD OF THE INVENTION

The present invention relates to a lifting clamp having a clamp body defining a chamber for picking up the goods or articles to be lifted and transported, and including two facing jaws. At least one jaw can be moved toward or away from the other jaw, which can be stationary, within the chamber for picking up the goods or articles.

BACKGROUND OF THE INVENTION

Lifting clamps of this type serve as means for up and conveying sheet-metal panels, welded structures, machine members or the like. In the case of known lifting clamps of this type, a one-part spindle is mounted to rotate within the clamp member as a device to actuate movement of the jaws. Rotation of the spindle causes inward or outward movement of the jaw connected with the spindle relative to the jaw which is facing the movable jaw, within the chamber, for picking up the goods or articles by the clamp.

To tightly clamp or to release an article (for instance, a sheet-metal panel) held between the two operating jaws, for a transporting step accomplished by means of a crane, the projecting length of that part of the spindle which can be driven for the movement of the jaw and which projects outward at the side of the clamp member turned away from the chamber for picking up the goods is of dimensions corresponding to those of the article to be picked up. The spacing of the two jaws relative to one another can be great when a correspondingly thick sheet-metal plate or a stack of a plurality of sheet-metal plates placed one over the other is or is to be or should be clamped tightly in the chamber for picking up the goods and articles. Consequently, dependent upon the desired use of the known lifting clamp, the end of the spindle, which is turned away from the chamber for picking up goods and articles, can project quite some distance out of the clamp member.

In the case of limited clearance dimensions, for instance in vertical sheet-metal stacking and storage arrangements where the sheet-metal panel or pluralities of sheet-metal panels to be prepared for conveyance are arranged very tightly adjacent to one another, this known lifting clamp cannot be used. The known lifting clamp intended to grip the sheet-metal panels by means of the projecting parts between the one spindle end and the clamp member cannot be introduced into the vacant space which is opened up by separation of the sheet-metal panels from one another in the vertical storage arrangement.

SUMMARY OF THE INVENTION

An object of the present invention is to provide a lifting clamp with a compact structure.

Another object of the present invention is to provide a lifting clamp with enhanced adjustability.

The foregoing objects are obtained by a lifting clamp comprising a clamp body defining a chamber for receiving articles, first and second opposing and facing jaws coupled to the clamp body, and a drive mechanism, coupling the second jaw to the clamp body for moving the second jaw along a path relative to the first jaw within the chamber to engage the articles between the jaws. The drive mechanism has a spindle with first and second spindle parts. The first spindle part is rotatably mounted in the clamp body. The second spindle part supports the second jaw and is guided for longitudinal movement in the first spindle part. The first spindle part drives the second spindle part to move the second jaw.

Instead of a one-part spindle according to the present state of the art, a two-part spindle is used as a control device for moving the jaws which are part of a lifting clamp. By a rotary movement of the first spindle part of the two-spindle, which first spindle part is mounted to be rotatable in the clamp body, the second spindle part can be driven into the chamber for picking up the goods for the tight clamping or withdrawn for the release of goods or articles to be transported. The second spindle part carries the jaw which can be moved forward or rearward, can be guided and driven by this arrangement longitudinally within the first spindle part, and can be thrust telescopically in or out of the first spindle part.

In this manner, the transport or handling movements necessary for the tight clamping and release of an article need to be executed, at least partially, by the second spindle part within the chamber for picking up the goods. The movements need not be executed, at least partially, by the first spindle part, such that the projecting parts of the end of the first spindle part arranged remote the moveable jaw and projecting outwardly from the clamp body in any case are smaller than the corresponding projecting parts in known lifting clamps, if the same path of movement of the jaw is considered for the comparison.

The path of movement of the movable jaw can extend in a straight line, and preferably extends in a horizontal plane. Because of this path, optimum application of the force of the clamp on the goods or articles to be picked up and held tightly, for instance a sheet-metal plate, is attained. The articles can be introduced, transverse to the horizontal path of movement of the jaw, into the chamber for picking up the goods which is part of the lifting clamp.

In one preferred embodiment of the lifting clamp according to the present invention, the second spindle part has an outside thread or worm guided into an inside thread or worm of the first spindle part, and the first spindle part has an outside thread or worm guided into a continuous inside thread or worm within the clamp body. The outside thread or worm of the first spindle part and that of the second spindle part are arranged to run counter to each other. According to the direction of rotation of the first spindle part, the second spindle part is moved either toward or away from the oppositely facing first jaw. Dependent upon the thread pitches selected for the thread or worm used in each of the spindle parts, revolution of the first spindle moves the first spindle part toward or away from the first jaw by a longitudinal thrust of the first spindle part within the inside threading of the clamp body. The second spindle part is moved along with it for a portion of the distance of the passage covered by the first spindle part. The second spindle part is transported simultaneously and telescopically inward and outward relative to the first spindle part, in order to cover a corresponding distance toward or away from the first jaw for a certain stretch of the path.

If these simultaneously covered transport paths of the first and the second spindle parts are added together, with any one revolution of the spindle, the movable second jaw covers a greater distance, than with the known lifting clamp with a one-part spindle. The thrust distance of the end of the two-part spindle arranged outside the clamp body, but adjacent to the chamber for picking up the goods or articles, during release of the goods or articles which are being held tightly by the clamp (i.e., during the withdrawal movement of the spindle), is a smaller distance than in the case of the known one-part spindles. The distance is smaller since during each rotary movement of the first spindle part when the first spindle part is rotated to move outward from the clamp body for opening or widening the clamp clearance, the second spindle part, dependent upon the thread pitches, is moved simultaneously and telescopically into the first spindle part to enlarge the clamp clearance. Since with each revolution of the first spindle part a more lengthy transport path is obtained for the movable jaw in the chamber as compared with the known lifting clamps, the transport passages of the present invention required for tight clamping or release of the goods or articles to be transported are covered in a shorter time.

In one especially preferred embodiment, all of the threads of the spindle worm drive are of nearly identical thread pitch. With this arrangement, together with the two-part spindle arrangement according to the present invention, each spindle revolution provides a double length of distance for the movable jaw, in comparison with the lifting clamps according to the start of the art (i.e., those having only one spindle or worm gear and comparable thread pitch). Furthermore, with the lifting clamp according to the invention, in comparison with the devices known until this time, the clamp clearance formed by the two jaws can be enlarged or be reduced in half the time required before.

In another embodiment of the lifting clamp according to the present invention, the first spindle part is made rotatable, but remains axially immovable. This is preferably accomplished by means of a bushing mechanism or shaft insert, extending in the clamp body parallel to the path of movement of the movable jaw and supporting the first spindle part in the clamp body. With this arrangement, the second spindle part can be driven axially without the first spindle part being subjected to any axial transport or handling movement of the same sort. A permanent and very slight projecting distance of the outside end of the two-part spindle, opposite the chamber of the clamp body for picking up the goods or articles, can be considered to be suitable. In the case of especially limited space, this can be an advantageous arrangement when combined with the use of the lifting clamp. The second spindle part with the jaw, considered relative to the length of the path to be covered and relative to the time required for this purpose, however, behaves the same as a one-part spindle with a comparable thread pitch.

In one further preferred embodiment, the two-part spindle includes a safeguard against revolution, which secures both of the spindle parts With the drive or revolution of the first spindle part, the second spindle part is not driven or rotated along concurrently during the rotary movement of the first spindle part by friction forces between the threads of the first and the second spindle parts. Concurrent rotation of the first and second spindle parts could prevent movement of the second jaw which is to be moved relative to the first jaw. The rotary movement of the second spindle part is forcibly prohibited by means of the safeguard mechanism, which safeguard mechanism provides a corresponding setting or blocking movement of the second spindle part with the clamp body.

In another especially preferred embodiment, the second spindle part has a ball end, at the end of the spindle projecting into the chamber for picking up the goods or articles, on which the movable second jaw is pivotably mounted. The second jaw is configured in convex shape in its end turned toward or facing the first jaw, the radius of curvature of the convex end of the second jaw is greater than the pivot radius of the second jaw during pivoting of the second jaw around the ball end. Under stress or under a load, when one particular article is clamped between the two facing jaws and the article is raised from the ground by means of the lifting clamp, the pivotable second jaw is pivoted downward as a result of distribution of the load, reducing the clamp clearance between the facing jaws as a result of the pivoting. This leads to a reinforced clamping of the goods or articles here are being picked up in the clamp clearance. The greater the weight of the goods or articles being lifted and clamped tightly between the two jaws, the greater is the inclination of the settable and adjustable jaw to pivot downward, and the greater is the leverage of retaining force between the two jaws which face one another. This heightens the security of the grip with use of the lifting clamp according to present invention.

In another especially preferred embodiment, to drive the first spindle part, the two-part spindle is provided with an actuating member in the form of a star-shaped handle, similar to a handle for a clamp screw. A handle of this type facilitates rapid and powerful opening and closing of the spindle part of the lifting clamp.

In known lifting clamps, the actuating member is most generally a spindle plug which is feed-adjusted only very approximately to the relevant lifting clamp, for opening or for closing the lifting clamp, by rotation of the one-part spindle. It can be used in the end of the spindle which is facing the chamber for picking up goods for the rotary movement. This spindle plug can be very easily lost such that the known lifting clamps can only be opened or closed by means of other tools. Although the spindle plug can be tightly connected with the end of the one-part spindle of the known lifting clamp, this incurs the danger that the lifting clamp will open automatically and inadvertently, especially if this spindle plug projects out beneath the lifting clamp in its closed setting for the tight clamping of goods or articles to be transported. When the goods or articles are set down, this spindle plug may be operated inadvertently; for instance as a result of placing the lifting clamp against an adjacent stack of plates, and the lifting clamp may consequently be opened automatically, releasing the goods. These drawbacks are absolutely avoided in the case of the two-part spindle embodiment of the lifting clamp according to the present invention, since a projecting part of this star-shaped handle cannot be located beneath the clamp, which could lead to inadvertent, undesired and dangerous opening of the lifting clamp.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawing which form a part of this disclosure.

DETAILED DESCRIPTION OF THE INVENTION

Figure 1:
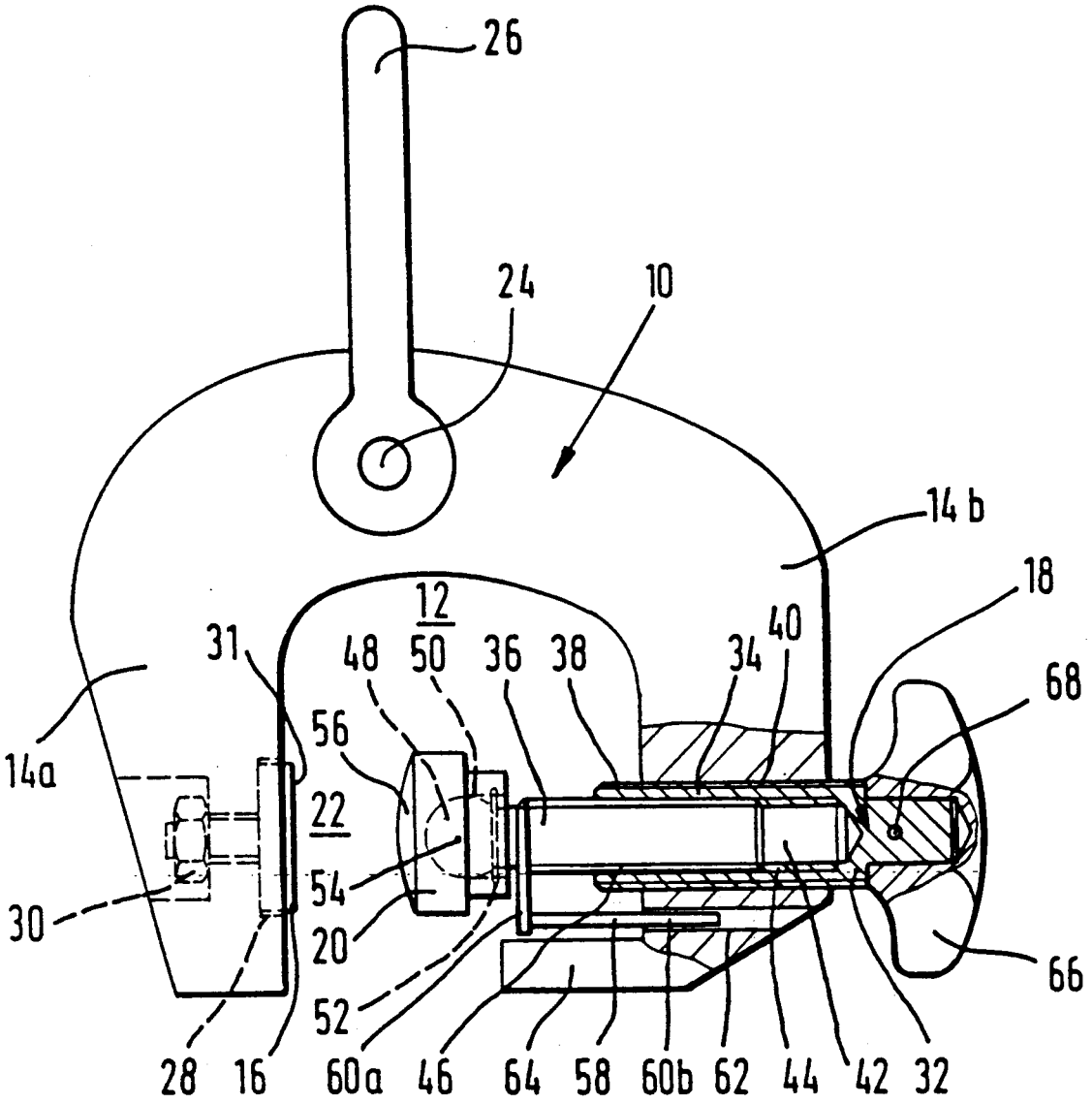
FIG. 1 is a side elevational view of a lifting clamp according to a first embodiment of the present invention.

The lifting clamp of the present invention comprises a clamp body 10 which is essentially C-shaped in the side view shown in FIG. 1 and which defines a chamber 12 for picking up goods or articles. In the facing and opposing wings 14*a* and 14*b* of clamp body 10, one stationary jaw 16 is mounted in wing 14*a*, and one device or means for moving a movable jaw 20 toward or away form stationary jaw 16 is mounted in the other wing 14*b*.

A variable clamp clearance 22 between the jaws to receive the goods or articles to be transported is limited in its breadth by the two jaws 16 and 18. The goods or articles can be a sheet-metal plate, or a plurality of sheet-metal plates or the like. To transport the lifting clamp carrying the goods to be transported by means of a lifting tool, for instance a crane (not shown), a shackle or linking member 26 is articulated or pivoted onto the top surface or bight of clamp member 10 and held rotatable by a bolt member 24 passing all the way through clamp member 10. Shackle 26 is essentially a U-shaped member configured to receive a load hook (now shown) of the crane.

Stationary jaw 16 is inserted into a recess 28 in wing 14*a* of clamping body 10 and is connected tightly with the body by a screw connection 30. Stationary jaw 16 projects beyond recess 28 with its free end facing toward movable jaw 20, to form a flat and essentially vertical clamping surface 31 to hold the goods or articles which are to be clamped and to hold them out of recess 28.

For the movement of movable jaw 20, device 18 is formed of a two-part spindle 32, including first and second spindle parts 34 and 36. First spindle part 34 has an uninterrupted outside or external thread or worm 38, guided into a continuous inside or internal thread or worm 40 of wing 14*b* of clamping body 10. Thread 40 is cut into a bore in wing 14*b* of clamping body 10, extends essentially horizontally, and has a diameter corresponding to the diameter of first spindle part 34. In the exemplary embodiment of the lifting clamp shown in the single illustrative drawing, outside thread 38 of first spindle part 34 has a greater length than the continuous inside thread 40 of wing 14*f* of clamp body 10.

The inside of first spindle part 34 comprises bore 42, of somewhat shorter length than that of the outside thread 38 of first spindle part 34. An inside or internal thread 44 is cut into this bore 42 having a diameter corresponding to the diameter of second spindle part 36. Outside or external thread 46 of second spindle part 36 is guided into inside thread 44. For the longitudinal movement of movable jaw 20, outside thread 46 extends over the entire length of second spindle part 36. Outside thread 38 of first spindle part 34 and continuous inside thread 40 of clamp body 10 in this case are right-hand threads. Outside thread 46 of second spindle part 36 and inside thread 44 of first spindle part 34 in turn are left-hand threads. Outside thread 38 of first spindle part 34 and outside thread 46 of second spindle part 36 thus run counter to each other. All of the threads used for the (spindle) worm drive in this case have approximately identical thread pitch.

The end of second spindle part 36 turned toward stationary jaw 16 is covered by a ball end 48. A recess 50 corresponding to the diameter of ball end 48 is located in the movable jaw in order to receive ball end 48 in a known, and thus, not further explained manner. The ball end is retained in recess 50 by a snap ring 52 for the connection of movable jaw 20 with second spindle part 36. Movable jaw 20 is mounted on ball end 48 such that it can be pivoted around the ball middle axis 54, extending perpendicular to the plane of the drawing, for a certain distance either upward or downward. The free end 56 of movable jaw 20 turned toward stationary jaw 16 is of convex shape. The radius of curvature of the convex end is greater than the pivot radius of movable jaw 20 when it pivots on ball end 48.

A retaining member 58 is connected securely with the bottom of second spindle part 36. The retaining member has two surfaces or portions 60*a* and 60*b* extending perpendicular to one another. Surface or portion 60*b* extends parallel to the path of movement axially in a longitudinal guide or slot 62 in wing 14*b* of clamp body 10 extending in the same direction. This retaining member 58 provides a safeguard against revolution, preventing spindle part 36 from any counter-revolution which may prejudice the transport or handling movements of movable jaw 20. Longitudinal guide 62 extends in two directions all the way through the entire wing 14*b* of clamp body 10 and reaches the outside with both of its ends on the two opposite sides of wing 14*b*.

Wing 14*b* has a cantilever portion 64 on its bottom. The cantilever portion protects the device 18 from damaging impacts which may occur during the placement of the lifting clamp on a sheet-metal plate stack, while the clamp is being lowered.

At its opposite end from chamber 12 for picking up goods or articles, the two-part spindle 32, on first spindle part 34, has a connecting bolt 68 retaining a gripper 66 in the form of a star-shaped handle for manual actuation of the worm gears of this spindle.

The lifting clamp according to the invention operates essentially in the following manner. When star-shaped handle 66 is rotated to the right in a clockwise direction, as seen in the illustration, because of the right-hand pitch of the threads 38 and 40 cooperating with one another, the first spindle part 34 is moved to the left, as seen in the illustration, and thus into chamber 12 for picking up goods or articles. Because of the left-hand pitch of the threads 44 and 46, with this clockwise rotary movement of the first spindle part 34, the second spindle part 36 is simultaneously thrust telescopically out of the first spindle part 34, and movable jaw 20 is moved in the direction of stationary jaw 16 and therewith the breadth of the clamp clearance 22 is decreased.

Since the pitches of all of the threads 38, 40, 44, 46 used for the (spindle) worm drive are essentially identical, during any spindle revolution occuring after having been actuated by the star-shaped handle 66, the same distance is covered in half the time with the jaw 20 as compared with the known lifting clamps having only one-part spindle and having a comparable thread pitch. As soon as the material to be transported has been placed securely between jaws 16 and 20, the manual rotary movement which has taken place as controlled by star-shaped handle 66 is terminated and the lifting clamp is raised by means of a lifting tool, for instance a crane or traveling crane (not shown).

The crane load hook (not shown) engages the opening of the U-shaped shackle 26. During this upward movement of the lifting clamp generated by the lifting tool, movable jaw 20 is pivoted downward around axis 54. The greater the suspended load, the further it is pivoted downward. Thus, the top half of the convex end 56 is pivoted into the clamp clearance 22, diminishing the breadth of the clearance and providing a secure clamping of the goods or articles to be transported. With release of the lifting clamp, the already described steps are executed in reverse order, which need not be explained in greater detail.

Instead of a star-shaped handle 66 for manual actuation of the (spindle) worm gear, a different actuating member, for instance a clamp handle or a locking nut or the like, can also be used. According to one modification and especially for one embodiment of the lifting clamp according to the invention, the modification is simply that the outside periphery of the operating member does not extend out over the bottom of clamping body 10. Such extension of the operating member could lead to its unintentional and undesired actuation, and to the inadvertent and dangerous opening of the clamp.

Instead of using the stationary jaw 16, another movable jaw 20 moved by device 18 can also be used. In that case, two jaws can be moved toward and away from each other, located in clamping body 10, and powered by a device 18.

Figure 2:
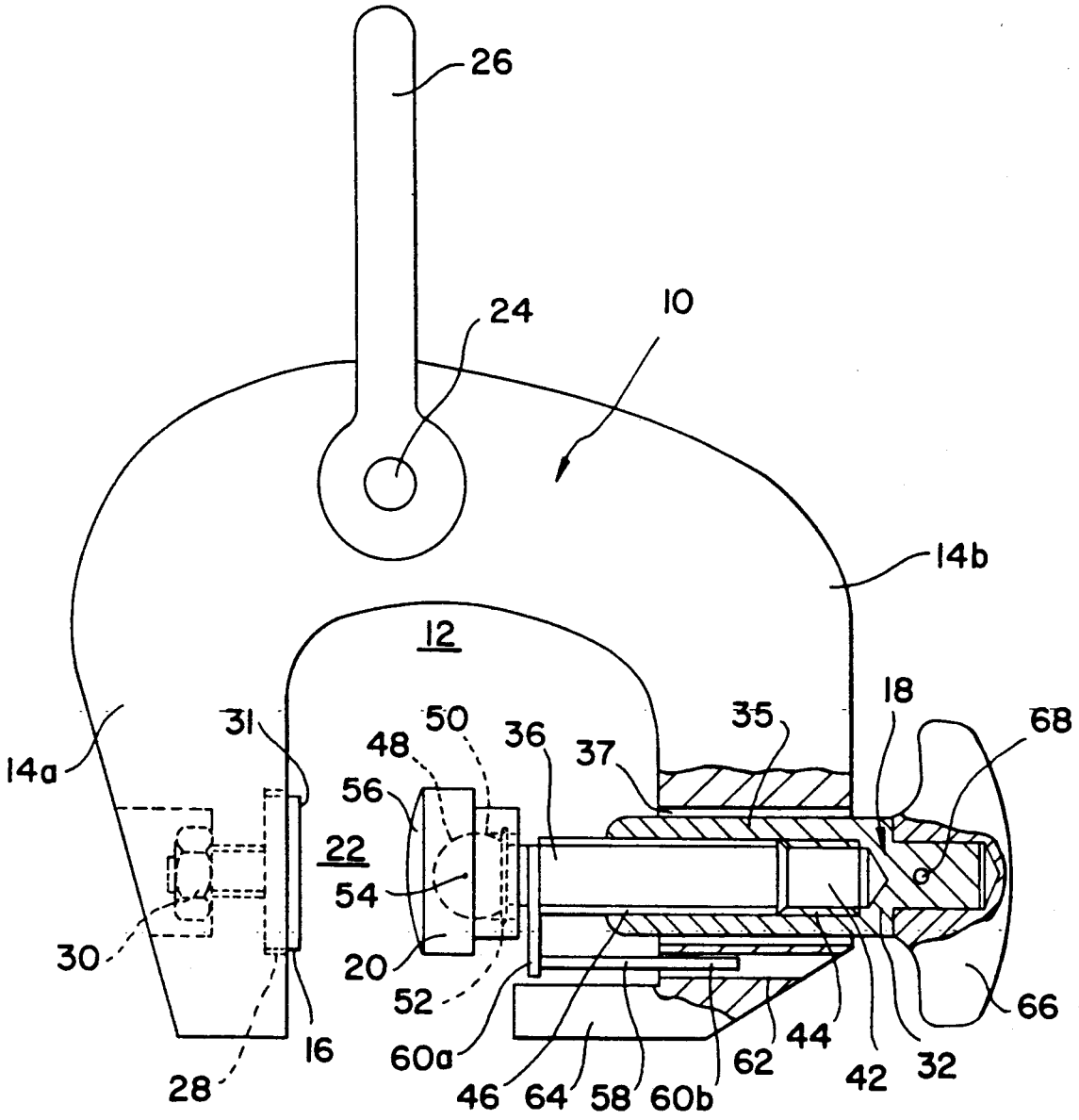
FIG. 2 is a side elevational view of a lifting clamp according to a second embodiment of the present invention.

Instead of a two-part spindle, a spindle with some other degree of multiple could also be used, for instance a three-part spindle. Also, instead of the first spindle part 34 extending outwardly over the outside thread 38 into the continuous inside thread 40 of clamping body 10, a modified first spindle part is shown in FIG. 2 which is could be guided by means of a bushing or the shaft insert 37, extending in clamp body 10, parallel to the path of movement of the movable jaw 20 and supporting the first spindle part 35 so that it cannot slide axially but remains rotatable in clamp body 10. With this arrangement, the second spindle part 36 is moved linearally, without any axial movement of rotatable first spindle part 35 Thus, the actuating member for the spindles, which may be star-shaped handle 66, can be attached very tightly or closely to clamping body 10, which makes the projecting distance of first spindle part 35 and star-shaped handle 66 outward over the clamp body 10 very small. In that case, then, the same number of rotary movements as with the known lifting clamps with only one-part spindles with comparable thread pitch must be applied to the first spindle part, in order to transport the second spindle part with movable jaw 20 linearally into the relevant position.

While various embodiments have been chosen to illustrate the invention, it will be understood by those skilled in the art that various changes and modifications can be made therein without departing from the scope of the invention as defined in the appended claims.

What is claimed is:

1. A lifting clamp for the lifting and conveyance of loads, comprising:

a clamp body defining a chamber for receiving articles;

lifting means, coupled to said clamp body, for attaching said body to a lifting tool;

first and second jaws coupled to said clamp body, said jaws opposing and facing one another; and drive means, coupling said second jaw to said clamp body, for moving said second jaw along a path relative to said first jaw within said chamber to engage the articles between said jaws, said drive means including a spindle having first and second spindle parts, said first spindle part being rotatably mounted in said clamp body, said second spindle part supporting said second jaw and being guided for longitudinal movement in said first spindle part, said first spindle part driving said second spindle part, said second spindle part having a ball end on a free end thereof projecting into said chamber, said second jaw being pivotally mounted on said ball end.

2. A lifting clamp according to claim 1 wherein said drive means moves said second jaw along a straight line path in a horizontal plane.

3. A lifting clamp according to claim 1 wherein said second spindle part comprises a first external thread; and said first spindle part comprises a first internal thread, said first internal thread receives and mates with said first external thread.

4. A lifting clamp according to claim 3 wherein said first spindle part comprises a second external thread; and said clamp body comprises a second internal continuous thread, said second internal thread receives and mates with said second external thread, defining an axis coaxial to the movement of said second jaw.

5. A lifting clamp according to claim 4 wherein said first internal and external threads and said second internal and external threads run counter to one another.

6. A lifting clamp according to claim 5 wherein said second internal and external threads of said first spindle part and said clamp body have a right-hand thread pitch; and wherein said first internal and external threads of said first spindle part and said second spindle part have a left-hand thread pitch.

7. A lifting clamp according to claim 5 wherein said first and second, internal and external threads have an approximately identical thread pitch.

8. A lifting clamp according to claim 3 wherein said first spindle part is rotatably mounted in said clamp body, but is restrained from sliding axially.

9. A lifting clamp according to claim 1 wherein said spindle comprise safeguard means for preventing rotation of said spindle by securing said first and second spindle parts

10. A lifting clamp according to claim 9 wherein said safeguard means comprises a retaining member having one end thereof fixed to said second spindle part and another end received in a longitudinal guide in said clamp body.

11. A lifting clamp according to claim 10 wherein said ends of said retaining member extend perpendicularly to each other; and wherein said longitudinal guide extends in said clamp body parallel to said path of said second jaw.

12. A lifting clamp according to claim 1 wherein said second jaw has a convex end facing first jaw.

13. A lifting clamp according to claim 12 wherein said convex end has a radius of curvature greater than a pivot radius of said second jaw as provided by said ball end.

14. A lifting claim according to claim 1 wherein said spindle comprises an actuating member for rotating said first spindle part in both directions of rotation relative to said clamp body.

15. A lifting clamp according to claim 14 wherein said actuating member comprises a star-shaped handle fixedly connected on said first spindle part opposite said second jaw and outside said clamp body.

16. A lifting clamp according to claim 15 wherein a bolt fixedly connects said handle to said first spindle part.

17. A lifting clamp according to claim 1 wherein said first jaw is axially immovably connected with said clamp body, and comprises a flat clamp surface.

18. A lifting clamp according to claim 1 wherein said lifting means comprises a shackle for receiving a load hook of a lifting mechanism.

19. A lifting clamp according to claim 1 wherein said clamp body comprises a generally U-shaped member with two legs connected by a base and a cantilever portion extending from a free end of one of said legs parallel and adjacent to said spindle, for protecting said spindle from contact with the articles received in said chamber.

20. A lifting clamp for the lifting and conveyance of loads, comprising:

a clamp body defining a chamber for receiving articles;

lifting means coupled to said clamp body for attachment to a lifting tool;

first and second jaws coupled to said clamp body, said jaws opposing and facing one another in said chamber; and drive means, coupling said second jaw to said clamp body, for moving said second jaw along a path relative to said first jaw within said chamber to engage the articles between said jaws, said drive means including a spindle having first and second spindle parts, and a bushing means for rotatably mounting said first spindle part in said clamp body and restraining said first spindle part from axial movement, said second spindle part supporting said second jaw and being guided for longitudinal movement in said first spindle part, said first spindle part driving said second part, said second spindle part having a ball end on a free end thereof projecting into said chamber, said second jaw being pivotally mounted on said ball end.

21. A lifting clamp, comprising:

a clamp body having first and second wings defining a chamber for receiving articles, said body having a longitudinal guide therethrough and a cantilever portion extending from one of said wings partially into said chamber;

first and second jaws coupled to said first and second wings respectively, said jaws opposing and facing one another;

a spindle having first and second spindle parts, said first spindle part being rotatably mounted in said clamp body, said second spindle part supporting said second jaw and being driven and guided longitudinally by said first spindle part;

actuating means coupled to said first spindle for selectively rotating said first spindle part relative to said body; and safeguard means for relatively preventing rotation of said second spindle part comprising a retaining member having one end fixed to said second spindle part and another end received in said longitudinal guide in said clamp body, whereby said actuating means rotates said first spindle part, said first spindle part driving said second spindle part into said chamber and clamping an article to be lifted.

22. A lifting clamp for the lifting and conveyance of loads, comprising:

a clamp body defining a chamber for receiving articles, said clamp body having a generally U-shaped member with two legs connected by a base;

lifting means, coupled to said clamp body, for attaching said body to a lifting tool;

first and second jaws coupled to said clamp body, said jaws opposing and facing one another;

drive means, coupling said second jaw to said clamp body, for moving said second jaw along a path relative to said first jaw within said chamber to engage the articles between said jaws, said drive means including a spindle having first and second spindle parts, said first spindle part being rotatably mounted in said clamp, said second spindle part supporting said second jaw and being guided for longitudinal movement in said first spindle, said first spindle part driving said second spindle part; and a cantilever portion extending from a free end of one of said legs of said clamp body parallel and adjacent to said spindle, for protecting said spindle from contact with the articles received in said chamber.

23. A lifting clamp for the lifting and conveyance of loads, comprising:

a clamp body defining a chamber for receiving articles, said clamp body having a generally U-shaped member with two legs connected by a base;

lifting means coupled to said clamp body for attachment to a lifting tool;

first and second jaws coupled to said clamp body, said jaws opposing and facing one another in said chamber;

driving means, coupling said second jaw to said clamp body, for moving said second jaw along a path relative to said first jaw within said chamber to engage the articles between said jaws, said drive means including a spindle having first and second spindle parts, and a bushing means for rotatably mounting said first spindle part in said clamp body and restraining said first spindle part from axial movement, said second spindle part supporting said second jaw and being guided for longitudinal movement in said first spindle part, said first spindle part driving said second part; and a cantilever portion extending from a free end of one of said legs of said clamp body parallel and adjacent to said spindle, for protecting said spindle from contact with the articles received in said chamber.

* * * * *